United States Patent [19]

Brewington et al.

[11] Patent Number: 5,047,806

[45] Date of Patent: Sep. 10, 1991

[54] METERLESS SINGLE COMPONENT DEVELOPMENT

[75] Inventors: Grace T. Brewington; John F. Knapp, both of Fairport, N.Y.

[73] Assignee: Xerox Corporation, Stamford, Conn.

[21] Appl. No.: 537,660

[22] Filed: Jun. 14, 1990

[51] Int. Cl.[5] ..... G03G 15/06

[52] U.S. Cl. ..... 355/259; 118/653; 118/661; 355/245; 355/260

[58] Field of Search ..... 355/245, 246, 251, 259, 355/260; 118/653, 656–658, 661, 651

[56] References Cited

U.S. PATENT DOCUMENTS

| | | | |
|---|---|---|---|
| 4,036,175 | 7/1977 | Philips et al. | 118/651 |
| 4,383,497 | 5/1983 | Tejima | 118/651 |
| 4,407,925 | 10/1983 | Liebman | 118/657 X |
| 4,445,771 | 5/1984 | Sakamoto et al. | 355/259 |
| 4,608,328 | 8/1986 | Schwar et al. | 118/653 X |
| 4,806,992 | 2/1989 | Yasuda et al. | 355/300 |
| 4,833,059 | 5/1989 | Tomura et al. | 355/259 X |
| 4,972,230 | 11/1990 | Wayman | 355/246 |
| 4,990,958 | 2/1991 | Brewington et al. | 355/245 |

FOREIGN PATENT DOCUMENTS

| | | | |
|---|---|---|---|
| 0184363 | 10/1984 | Japan | 355/246 |
| 0195668 | 11/1984 | Japan | 355/245 |
| 0173075 | 7/1989 | Japan | 355/260 |

*Primary Examiner*—A. T. Grimley
*Assistant Examiner*—Matthew S. Smith
*Attorney, Agent, or Firm*—H. Fleischer; J. E. Beck; R. Zibelli

[57] ABSTRACT

An apparatus which develops a latent image recorded on an image receiving member with marking particles. A chamber in a developer housing stores a supply of charged marking particles. The marking particles having a charge distribution. A donor roll is positioned in the chamber of the housing to transport marking particles closely adjacent to the latent image to develop the latent image. A rotating, elongated member moves the marking particles. An electrical bias is applied between the elongated member and the donor roll to selectively attract marking particles from the elongated member to the donor roll. The marking particles attracted to the donor roller have a charge distribution with a selected range. The range of the charge distribution of the marking particles attracted to the donor roller is less than the range of the charge distribution of the marking particles being moved by the elongated member.

20 Claims, 4 Drawing Sheets

METERLESS SINGLE COMPONENT DEVELOPMENT

This invention relates generally to an electrophotographic printing machine, and more particularly concerns a development apparatus in which toner particles are moved from one end of a developer housing to the other end thereof by a member while being attracted from the member to a donar roll adapted to transport the toner particles to a development zone adjacent a photoconductive member having an electrostatic latent image recorded thereon.

In an electrophotographic printing machine, a photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing a developer material into contact therewith. This forms a powder image on the photoconductive member which is subsequently transferred to a copy sheet. The copy sheet is heated to permanently affix the marking particles thereto in image configuration.

In the foregoing type of printing machine, a development system is employed to deposit developer material onto the electrostatic latent image recorded on the photoconductive surface. Generally, the developer material comprises toner particles adhering triboelectrically to coarser carrier granules. Typically, the toner particles are made from a thermoplastic material while the carrier granules are made from a ferromagnetic material. Alternatively, a single component material may be employed. A single component material may be made from magnetic or non-magnetic toner particles. In a single component development system, no carrier granules are used, a mehanical toner mover pre-loads a toner layer onto a donor roll surface. In turn, the pre-loaded toner is metered and electrostatically charged at the metering/charging location by either a contacting blade or a highly toleranced rotating rod. The metered/charged toner is advanced on the donor roll to the development zone. At the development zone, toner is electrostatically stripped from the donor roll and deposited on the latent image forming a toner powder image. A development system of this type is described in co-pending application Ser. No. 07/428,726, filed Oct. 30, 1989. As described therein, a hollow tube having holes therein fluidizes and moves toner particles from one end of a developer housing to the other end thereof. The tube is electrically biased so that developer material is attracted from the tube to a donor roll. A charging blade is maintained in contact with the donor roll to charge the layer on the donor roll. Manufacturing of a metering/charging rod or blade is complex and expensive as it requires close tolerances and, sometimes, special materials. Furthermore, it is difficult to set-up and maintain a metering/charging blade or rod in a developer housing. Accordingly, it is desirable to eliminate the metering/charging blade or rod while still providing charged toner particles to the donor roll. Various approaches have been devised to solve this problem, the following disclosure appears to be relevant:

U.S. Pat. No. 4,036,175, patentee: Phillips et al., issued: July 19, 1977.

U.S. Pat. No. 4,383,497, patentee: Tajima, issued: May 17, 1983.

U.S. Pat. No. 4,445,771, patentee: Sakamoto et al., issued: May 1, 1984.

U.S. Pat. No. 4,806,992, patentee: Yasuda et al., issued: Feb. 21, 1989.

The relevant portions of the foregoing patents may be briefly summarized as follows:

U.S. Pat. No. 4,036,175 discloses a magnetic roller, partially immersed in developer material, for advancing the developer material to a drum. An electrical bias is applied between the roller and drum so that toner particles are attracted from the roller to the drum. The potential of the toner coating on the drum is raised by an electrostatic charging device, e.g. a Corotron, charging the toner.

U.S. Pat. No. 4,383,497 describes a magnetic roll and a developing roller. The toner and the carrier are mutually subjected to frictional charging by an agitating member. The magnetic roll transports the toner and carrier closely adjacent to the developing roller. An electrical bias is applied to the developing roller attracting toner particles thereto from the magnetic roller.

U.S. Pat. No. 4,445,771 discloses a reservoir which stores a one component type of developer, i.e. magnetic toner. A sleeve is associated with the reservoir to convey the toner from the reservoir. A magnet is positioned within the sleeve. A toner charging sleeve is interposed between the photoconductive drum and the developer roll to deposit a charge on the toner by friction.

U.S. Pat. No. 4,806,992 describes a developing roller and supply roller. The supply roller transports developer material to the developing roller. An elastic blade forms a thin film layer of developer on the developing roller and charges it.

Pursuant to the features of the present invention, there is provided an apparatus for developing a latent image recorded on an image receiving member. The apparatus includes a housing defining a chamber storing a supply of electrostatically charged marking particles therein with the marking particles having a charge distribution. Means, disposed at least partially in the chamber of the housing, transport the marking particles closely adjacent to the latent image recorded on the image receiving member. Means, disposed in the chamber of the housing and spaced from the transporting means, move the charged marking particles in the chamber of the housing. Means apply an electrical bias between the moving means and the transporting means to attract charged marking particles of the same polarity from the moving means to the transporting means with the marking particles attracted to the transporting means having a selected charge distribution with the range of the selected charge distribution being less than the range of the charge distribution of the marking particles in the chamber of the housing.

In accordance with another aspect of the present invention, there is provided an electrophotographic printing machine of the type having an electrostatic latent image recorded on a photoconductive member. The improvement includes a housing defining a chamber storing a supply of electrostatically charged marking particles having a charge distribution. Means, disposed at least partially in the chamber of said housing, transport marking particles closely adjacent to the electrostatic latent image recorded on the photoconductive member. Means, disposed in the chamber of the housing and spaced from the transporting means, for moving the charged marking particles in the chamber of the housing. Means apply an electrical bias between the moving means and the transporting means to attract charged marking particles of the same polarity from the moving means to the transporting means with the marking particles attracted to the transporting means having a selected charge distribution with the range of the selected charge distribution being less than the range of the charge distribution of the marking particles in the chamber of the housing.

Other aspects of the present invention will become apparent as the following description proceeds and upon reference to the drawings, in which.

Figure 2:
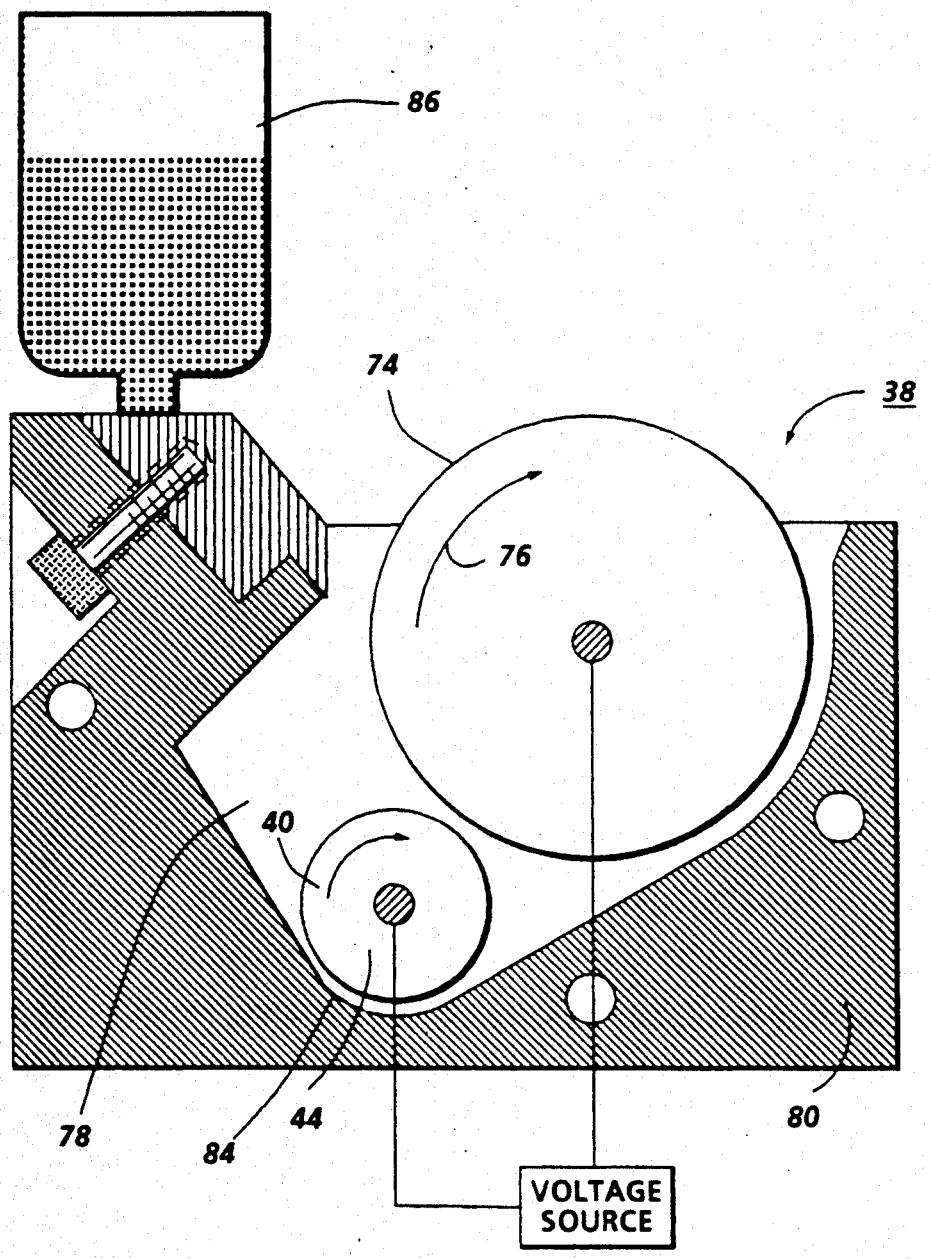
FIG. 2 is a schematic elevational view showing the development apparatus used in the FIG. 1 printing machine.
Figure 3A:
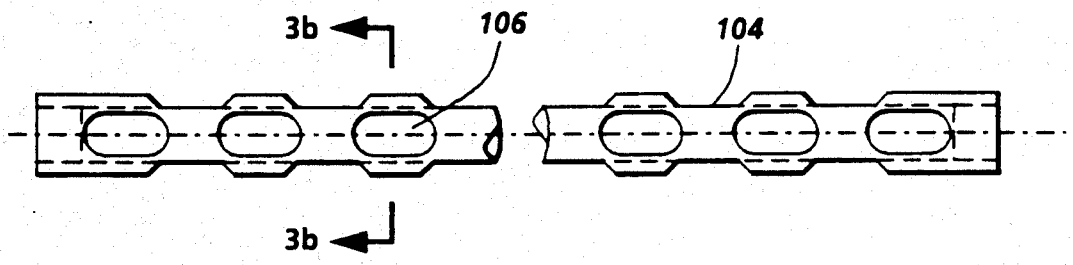
Figure 3B:
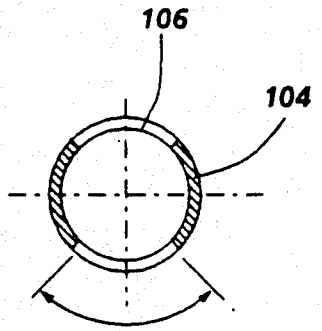
Figure 4A:
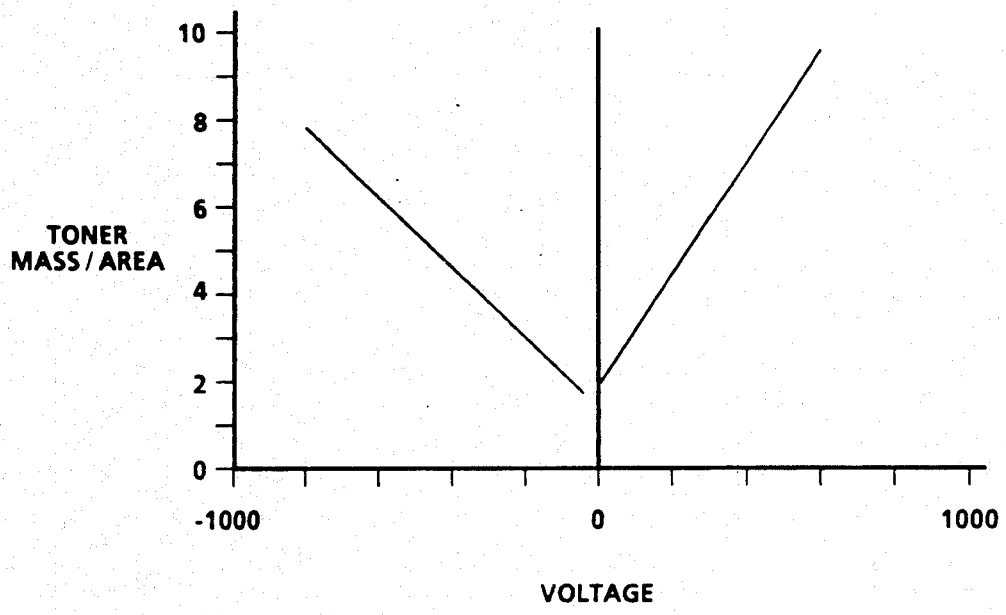
Figure 4B:
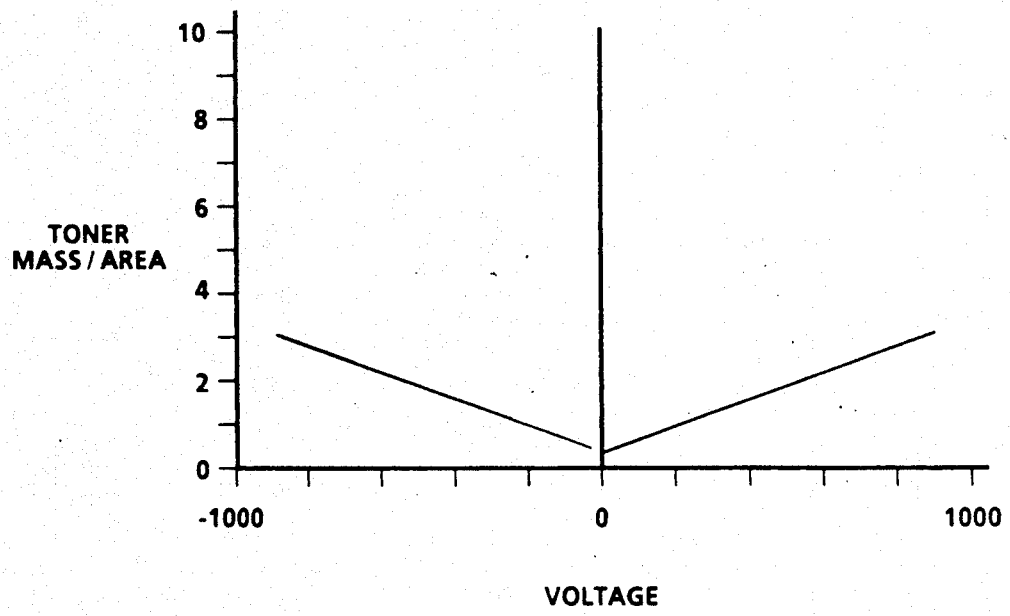

FIG. 3*a* is an elevational view depicting an elongated member used to used to move and charge the toner particles in the FIG. 2 development apparatus; and FIG. 3*b* is a side elevational view of the FIG. 3*a* elongated member;

FIG. 4*a* is a graph depicting the layer of toner mass loaded on the donor roller as a function of the electrical bias applied between the donor roller and the elongated member for one type of toner; and FIG. 4*b* is another graph depicting the layer of toner mass loaded on the donor roller as a function of the electrical bias applied between the donor roller and the elongated member for another type of toner.

While the present invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

Figure 1:
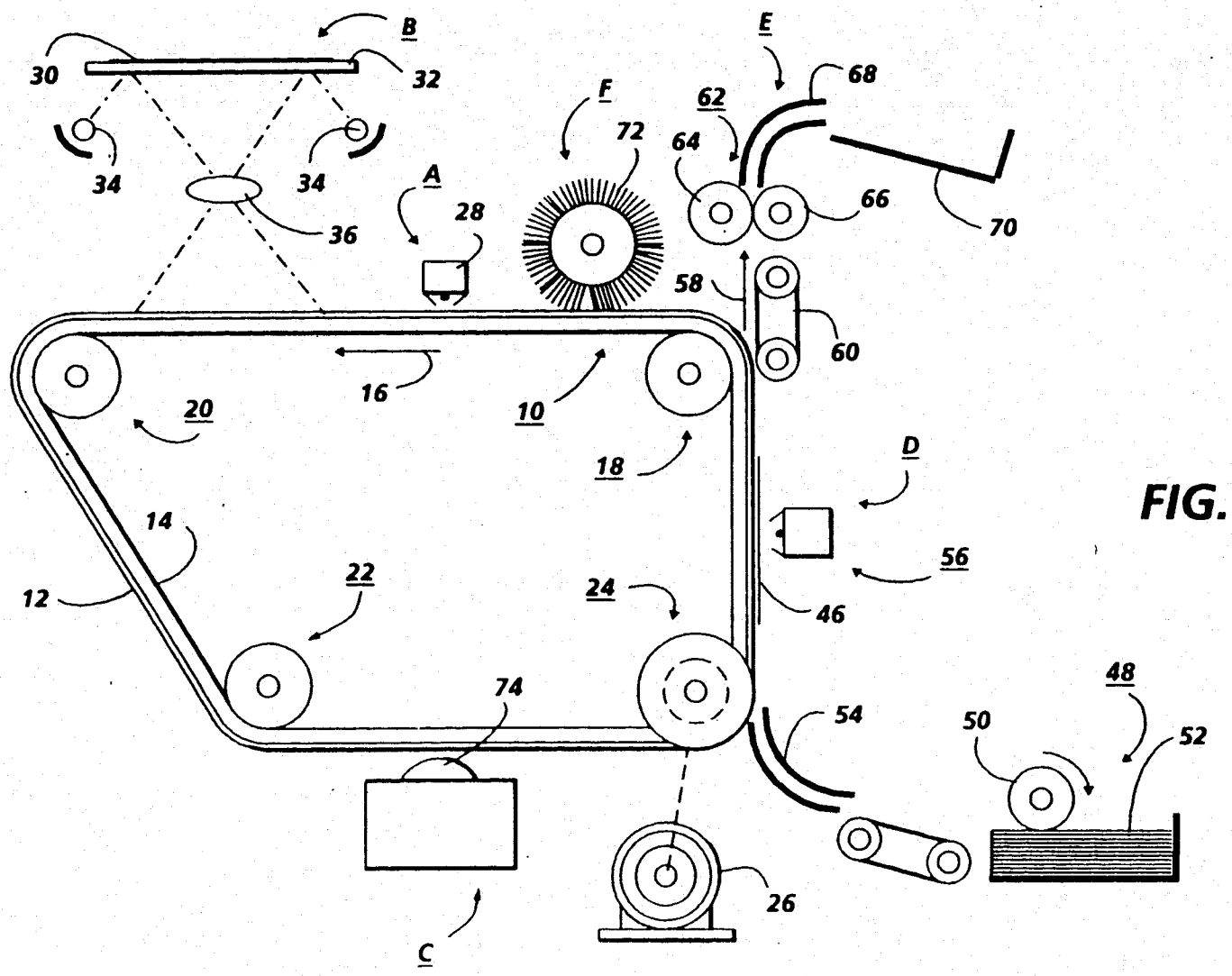
FIG. 1 is a schematic elevational view depicting an electrophotographic printing machine incorporating the development apparatus of the present invention therein.

For a general understanding of the features of the present invention, reference is made to the drawings. In the drawings, like reference numerals have been used throughout to designate identical elements. FIG. 1 schematically depicts the various elements of an illustrative elecgrophotographic printing machine incorporating the apparatus of the present invention therein. It will become evident from the the followiing discussion that this apparatus is equally well suited for use in a wide variety of printing machines and is not necessarily limited in its application to the particular embodiments depicted herein.

Inasmuch as the art of electrophotographic printing is well known, the various processing stations employed in the FIG. 1 printing machine will be shown hereinafter schematically and their operation described briefly with reference thereto.

Turning now to FIG. 1, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy which is electrically grounded. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained about rollers 18, 20, 22 and 24. Roller 24 is coupled to motor 26 which drives roller 24 so as to advance belt 10 in the direction of arrow 16. Rollers 18, 20, and 22 are idler rollers which rotate freely as belt 10 moves in the direction of arrow 16.

Initially, a portion of belt 10 passes through charging station A. At charging station A, a corona generating device, indicated generally by the reference numeral 28, charges a portion of photoconductive surface 12 of belt 10 to a relatively high, substantially uniform potential.

Next, the charged portion of photoconductive surface 12 is advanced through exposure station B. At exposure station B, an original document 30 is positioned face down upon a transparent platen 32. Lamps 34 flash light rays onto original document 30. The light rays reflected from original document 30 are transmitted through lens 36 forming a light image thereof. Lens 36 focuses the light image onto the charged portion of photoconductive surface 12 to selectively dissipate the charge thereon. This records an electrostatic latent image on photoconductive surface 12 which corresponds to the informational areas contained within original document 30 disposed upon transparent platen 32. Thereafter, belt 10 advances the electrostatic latent image recorded on photoconductive surface 12 to development station C.

At development station C, a developer unit, indicated generally by the reference numeral 38, transports a single component developer material of toner particles into contact with the electrostatic latent image recorded on photoconductive surface 12. Toner particles are attracted to the electrostatic latent image forming a toner powder image on photoconductive surface 12 of belt 10 so as to develop the electrostatic latent image. The detailed structure of developer unit 38 will be described hereinafter with reference to FIG. 2.

After development, belt 10 advances the toner powder image to transfer station D. At transfer station D, a sheet of support material 46 is moved into contact with the toner powder image. Support material 46 is advanced to transfer station D by a sheet feeding apparatus, indicated generally by the reference numeral 48. Preferably, sheet feeding apparatus 48 includes a feed roll 50 contacting the upper most sheet of a stack 52 of sheets 46. Feed roll 50 rotates to advance the upper most sheet from stack 52 onto a conveyor 53 which advances the sheet into chute 54. Chute 54 directs the advancing sheet of support material 46 into contact with photoconductive surface 12 of belt 10 in a timed sequence so that the toner powder image developed thereon contacts the advancing sheet of support material at transfer station D.

Transfer station D includes a corona generating device, indicated generally by the reference numeral 56, which sprays ions onto the backside of sheet 46. This attracts the toner powder image from photoconductive surface 12 to sheet 46. After transfer, the sheet continues to move in the direction of arrow 58 onto a conveyor 60 which moves the sheet to fusing station E.

Fusing station E includes a fuser assembly, indicated generally by the reference numeral 62, which permanently affixes the powder image to sheet 46. Preferably, fuser assembly 62 includes a heated fuser roller 64 and a back-up roller 66. Sheet 46 passes between fuser roller 64 and back-up roller 66 with the toner powder image contacting fuser roller 64. In this manner, the toner powder image is permanently affixed to sheet 46. After fusing, chute 68 guides the advancing sheet to catch tray 70 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fibrous brush 72 in contact with photoconductive surface 12. The pre-clean corona generator neutralizes the charge attracting the particles to the photoconductive surface. These particles are cleaned from the photoconductive surface by the rotation of brush 72 in contact therewith. Subsequent to cleaning, a discharge lamp (not shown) floods photoconductive surface 12 with light to dissipate any residual charge remaining thereon prior to the charging thereof for the next successive imaging cycle.

It is believed that the foregoing description is sufficient for purposes of the present application to illustrate the general operation of an exemplary electrophotographic printing machine incorporating the features of the present invention therein.

Referring now to FIG. 2, the detailed structure of developer unit 38 is shown thereat. The developer unit include a donor roller 74. Donor roller 74 may be a bare metal such as aluminum. Alternatively, the donor roller may be a metal roller coated with a thick material. By way of example, a polytetrafluoroethylene based resin such as TEFLON, a trademark of the DuPont Corporation, or a polyvinylidene fluoride based resin, such as KYNAR, a trademark of the Pennwalt Corporation, may be used to coat the metal roller. This coating acts to assist in charging the particles adhering to the surface thereof and aids in development. Still another type of donor roller may be made from stainless steel plated by a catalytic nickel generation process and impregnated with TEFLON. The surface of the donor roller is roughened from a fraction of a micron to several microns, peak to peak. An electrical bias is applied to the donor roller. The electrical bias applied on the donor roller depends upon the background voltage level of the photoconductive surface, the characteristics of the donor roller, the charge distribution of the toner particles, and the spacing between the donor roller and the photoconductive surface. It is thus clear that the electrical bias applied on the donor roller may vary widely. Donor roller 74 is coupled to a motor which rotates donor roller 74 in the direction of arrow 76. Donor roller 74 is positioned, at least partially, in chamber 78 of housing 80. A toner moving member, indicated generally by the reference numeral 44, advances the toner particles from one end of chamber 78 to the other end thereof. Movement of the toner particles from one end of the chamber to the other end is accomplished by fluidizing the toner particles and by the force of the new toner particles being added to the chamber at one end thereof. Fluidized toner particles seek their own level under the influence of gravity. Inasmuch as new toner particles are being added from container 86 into one end of the chamber 78 of housing 80, the force exerted on the fluidized toner particles by the new toner particles being added at that end moves the fluidized toner particles from that end of housing 80 to the other end thereof. One skilled in the art will appreciate that it is not necessary to fluidize the toner particles and that any suitable toner mover may be used. The toner particles in chamber 78 have a charge distribution which ranges from about −30 microcoulombs per gram to about +30 microcoulombs per gram. Toner mover or elongated member 44 is located in chamber 78 closely adjacent to an arcuate portion 84 of housing 80. Arcuate portion 84 is closely adjacent to elongated member 44 and wraps about a portion thereof. There is a relatively small gap or space between arcuate portion 84 and a portion of elongated member 44. New toner particles are added to one end of chamber 78 from container 86. As elongated member 44 rotates in the direction of arrow 40, toner particles are fluidized. A motor (not shown) rotates elongated member 44 at at least 300 revolutions per minute. The force exerted on the fluidized toner particles by the new particles being added to chamber 78 advances the fluidized toner particles from the end of the chamber, in which the new toner particles have been added, to the other end thereof. Elongated member 44 is made from an electrically conductive material, such as aluminum, which may be coated with an insulating material, such as a plastic material. Voltage source 42 is electrically connected to elongated member 44 and donor roller 74. An electrical bias ranging from about −100 volts to about −1000 volts is applied between donor roller 74 and elongated member 44. This electrical bias controls the toner mass formed on donor roller 74. Elongated member 44 is spaced from donor roller 74 to define a gap therebetween. This gap may range from about 0.05 centimeters to about 0.15 centimeters. The charged, fluidized toner particles being moved by elongated member 44 are selectively attracted to donor roller 74 to form a layer of charged toner thereon. The toner particle layer adhering to donor roller 74 has a charge distribution ranging from about −3 micorcoulombs per gram to about −30 microcoulombs per gram. Preferably, the toner particle layer attracted from elongated member 44 to donor roller 74 has a charge distribution ranging from about −5 microcoulombs per gram to about −20 microcoulombs per gram. Thus, the range of the charge distribution of the toner particles attracted from elongated member 44 to doner roller 74 is selective and smaller than the range of the charge distribution of toner particles in chamber 78 of housing 80. An example of a suitable toner composition is one made from 90% styrene butadiene with 10% magenta predispersion and a 1% surface additive composed of 10% potassium tetraphenyl borate on aerosil. Another example of a suitable toner composition is one made from 94% styrene butadiene with 5% FGL yellow pigment 1% aluminum salicylate and a 1% surface additive composed of 10% potassium tetraphenyl borate on aerosil. Still another suitable toner composition is made from 95% styrene butadiene with 5% neopen blue and a 1% surface additive composed of 10% potassium tetraphenyl borate on aerosil. The charge distribution of these toner particles, when attracted to donor roller 74, ranges from about −5 microcoulombs per gram to about −15 microcoulombs per gram. Donor roller 74 rotates in the direction of arrow 76 to move the toner particles attracted thereto into contact with the electrostatic latent image recorded on photoconductive surface 12 of belt 10. It is thus seen that elongated member 44 moves these toner particles from one end of the chamber to the other end thereof. Voltage source 42 applies an electrical bias between elongated member 44 and donor roller 74. In this way, toner particles attracted from elongated member 44 to donor roller 74 form a layer of charged toner particles thereon having a selected charged distribution with the range of the charge distribution of the toner particles attracted to the donor roller being smaller than the range of the charge distribution of toner particles being moved by elongated member 44 in chamber 78 of housing 80. Donor roller 74 transports the toner particles attracted thereto in the direction of arrow 76. Toner particles are attracted from donor roller 74 to the electrostatic latent image recorded on photoconductive surface 12 of belt 10 to form a toner powder image. The detailed structure of elongated member 44 will be described hereinafter with reference to FIGS. 3*a* and 3*b*.

Turning now to FIGS. 3*a* and 3*b*, there is shown the detailed structure of elongated member 44. As depicted thereat, elongated member 44 includes a hollow rod or tube 104 having four equally spaced rows of apertures or holes 106 therein. Each row of holes is spaced about the periphery of rod 104 by about 90°. Each hole in each row is spaced from the next adjacent hole. The holes are equally spaced from one another. In this way, as tube 104 rotates, the toner particles travel through the center of the tube and out through the various holes so as to be fluidized. In this embodiment, the fluidized toner particles are advanced from one end of the chamber of the developer housing to the other end thereof by the back pressure exerted by the head of fresh or new toner particles being discharged into the chamber from the toner storage container.

Referring now to FIGS. 4*a* and 4*b*, there is shown graphs of the toner mass adhering to the donor roller for different toner materials as a function of the voltage applied between the donor roller and the elongated member. For the first toner material shown in FIG. 4*a*, the toner mass varies from about 2.5 milligrams per centimeter$^2$ of roller surface for an electrical bias having a magnitude of about 250 volts to about 10 milligrams per centimeter$^2$ of roller surface for an electrical bias having a magnitude of about 1000 volts. For the second toner material shown in FIG. 4*b*, the toner mass varies from about 1.0 milligrams per centimeter$^2$ of roller surface for an electrical bias having a magnitude of about 100 volts to about 3.0 milligrams per centimeter$^2$ of roller surface for an electrical bias having a magnitude of about 1000 volts. The controlling mechanism for the pre-load charge distribution of the toner particle layer formed on the donor roller is a function of electrostatically and selectively stripping a fraction of the base toner powder charge distribution. This base toner distribution can, in turn, be controlled and adjusted by bulk constituents in the toner, surface additives on the toner, or surface additive preparation techniques. It is clear that the toner mass can be adjusted and controlled by many variables such as voltage between the donor roller and elongated member, design of the elongated member, rotational speed of the elongated member, toner materials, etc. One skilled in the art will appreciate that the toner particles may be magnetic particles or non-magnetic particles. Also, the polarity of the charge distribution of the toner particles may be negative or positive depending upon the characteristics of the photoconductive member. Of course, the polarity of the electrical bias must be suitable for the polarity of the toner particles used.

In recapitulation, it is clear that the apparatus of the present invention includes a rotating elongated member disposed in the chamber of the developer housing for moving toner particles therein. An electrical bias is applied between a donor rollr and the elongated member. The charged toner particles are attracted to the donor member. The range of the charge distribution of the toner particles attracted from the elongated member to the donor roller is selected and smaller than the range of the charge distribution of the toner particles being moved by the elongated member. Thus, toner particles are selectively attracted from the elongated member to the donor roller to form a layer of toner particles on the surface of the donor roller having a selected charge distribution. The donor member transports these toner particles closely adjacent to the photoconductive belt so as to develop the electrostatic latent image recorded thereon.

It is, therefore, evident that there has been provided, in accordance with the present invention a developer unit that fully satisfies the aims and advantages hereinbefore set forth. This developer unit has the advantage of not requiring a metering/charging blade or rod. While this invention has been described in conjunction with a preferred embodiment thereof, it is evident that many alternatives, modifications and varitions will be apparent to those skilled in the art. Accordingly, it is intended to embrace all such alternatives, modifications and variations as fall within the spirit and broad scope of the appended claims.

We claim:

1. An apparatus for developing a latent image recorded on an image receiving member, including:

a housing defining a chamber storing a supply of electrostatically charged marking particles therein with the marking particles having a charge distribution;

means, disposed at least partially in the chamber of said housing, for transporting marking particles closely adjacent to the latent image recorded on the image receiving member;

means, disposed in the chamber of said housing and spaced from said transporting means, for moving the charged marking particles in the chamber of said housing; and means for applying an electrical bias between said moving means and said transporting means to attract charged marking particles of the same polarity from said moving means to said transporting means with the marking particles attracted to said tranporting means having a selected charge distribution with the range of the selected charge distribution being less than the range of the charge distribution of the marking particles in the chamber of said housing.

2. An apparatus according to claim 1, wherein the charge distribution of the marking particles in the chamber of said housing ranges from about −30 microcouloumbs per gram to about +30 microcouloumbs per gram.

3. An apparatus according to claim 2, wherein the charge distribution of the marking particles attracted from said moving means to said transport means have a magnitude ranging from about 3 microcouloumbs to about 30 microcouloumbs per gram and have the same polarity.

4. An apparatus according to claim 2, wherein the charge distribution of the marking particles attracted from said moving means to said transport means preferably have a magnitude ranging from about 5 microcouloumbs to 20 microcouloumbs per gram and have the same polarity.

5. An apparatus according to claim 1, wherein said transporting means includes a donor roller.

6. An apparatus according to claim 5, wherein said moving means includes a rotatably mounted elongated member disposed interiorly of the chamber of said housing.

7. An apparatus according to claim 6, wherein said elongated member is made from an electrically conductive material having an insulating coating thereon.

8. An apparatus according to claim 7, wherein said applying means includes a voltage source electrically coupled to said elongated member to apply an electrical bias between said elongated member and said donor roller.

9. An apparatus according to claim 8, wherein said voltage source applies an electrical bias having a magnitude ranging from about 100 volts to about 1000 volts between said elongated member and said transporting means.

10. An apparatus according to claim 9, wherein said elongated member is spaced from said transporting means a distance ranging from about 0.05 centimeters to about 0.15 centimeters.

11. An electrophotographic printing machine of the type having an electrostatic latent image recorded on a photoconductive member; wherein the improvement includes:

a housing defining a chamber storing a supply of electrostatically charged marking particles having a charge distribution;

means, disposed at least partially in the chamber of said housing, for transporting marking particles closely adjacent to the electrostatic latent image recorded on the photoconductive member;

means, disposed in the chamber of said housing and spaced from said transporting means, for moving the charged marking particles in the chamber of said housing; and means for applying an electrical bias between said moving means and said transporting means to attract charged marking particles of the same polarity from said moving means to said transporting means with the marking particles attracted to said transporting means having a selected charge distribution with the range of the selected charge distribution being less than the range of the charge distribution of the marking particles in the chamber of said housing.

12. A printing machine according to claim 11, wherein the charge distribution of the marking particles in the chamber of said housing ranges from about −30 microcouloumbs per gram to about +30 microcouloumbs per gram.

13. A printing machine according to claim 12, wherein the charge distribution of the marking particles attracted from said moving means to said transport means have a magnitude ranging from about 3 microcouloumbs per gram to about 30 microcouloumbs per gram and have the same polarity.

14. A printing machine according to claim 12, wherein the charge distribution of the marking particles attracted from said moving means to said transport means have a magnitude preferably ranging from about 5 microcouloumbs per gram to about 20 microcouloumbs per gram and have the same polarity.

15. A printing machine according to claim 12, wherein said transporting means includes a donor roller.

16. A printing machine according to claim 15, wherein said moving and charging means includes a rotatably mounted elongated member disposed interiorly of the chamber of said housing.

17. A printing machine according to claim 16, wherein said elongated member is made from an electrically conductive material having an insulating coating thereon.

18. A printing machine according to claim 17, wherein said applying means includes a voltage source electrically coupled to said elongated member to apply an electrically bias between said elongated member and said donor roller.

19. A printing machine according to claim 18, wherein said voltage source applies an electrical bias having a magnitude ranging from about 100 volts to about 1000 volts between said elongated member and said transporting means.

20. A printing machine according to claim 19, wherein said elongated member is spaced from said transporting means a distance ranging from about 0.05 centimeters to about 0.15 centimeters.

* * * * *